United States Patent [19]

Lacis et al.

[11] 4,085,392

[45] Apr. 18, 1978

[54] REED SWITCH CONSTRUCTION

[75] Inventors: Laimons Lacis, Bloomfield; Steven Horvath, Irvington, both of N.J.

[73] Assignee: Gordos Corporation, Bloomfield, N.J.

[21] Appl. No.: 648,861

[22] Filed: Jan. 14, 1976

[51] Int. Cl.[2] ..... H01H 1/08

[52] U.S. Cl. ..... 335/58; 335/47; 335/154

[58] Field of Search ..... 335/154, 196, 151, 57, 335/58, 47, 55; 200/199

[56] References Cited

U.S. PATENT DOCUMENTS

| | | | |
|---|---|---|---|
| 2,312,672 | 3/1943 | Pollard, Jr. | 335/58 |
| 2,905,784 | 9/1959 | Ducati | 335/154 |
| 3,114,811 | 12/1963 | Kohman | 335/58 |
| 3,194,921 | 7/1965 | Watts, Jr. | 335/58 |
| 3,327,263 | 6/1967 | Korn | 335/154 |
| 3,348,175 | 10/1967 | Wilkis | 335/154 |
| 3,356,974 | 12/1967 | Funke | 335/154 |
| 3,716,810 | 2/1973 | Hara et al. | 335/154 |

*Primary Examiner*—Harold Broome

*Attorney, Agent, or Firm*—Dann, Dorfman, Herrell and Skillman

[57] ABSTRACT

The magnetic elements of a reed switch are supported within their non-magnetic capsule so that, instead of coming into contact in initially overlapping relationship, under the influence of a magnetic field they become essentially aligned with one another. The reeds may be so constructed that by selection of the size or shape of their respective opposed ends, the magnetic flux pattern is modified to maintain desired relative alignment to achieve desired contact. The invention relates to a mercury wetted switch which employs mercury to complete electrical contact between the non-contacting ends of the reeds.

3 Claims, 12 Drawing Figures

REED SWITCH CONSTRUCTION

Figure 1:
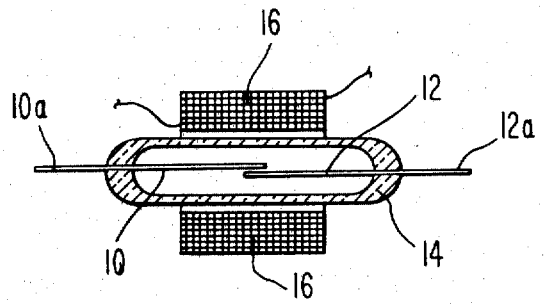
PRIOR ART Fig. 1

The present invention relates to an improved mercury wetted reed switch. More specifically, the present invention concerns a reed switch in which the switch contact ends of the magnetic elements are arranged so that they will not overlap and so that mercury by extending at least one of the magnetic elements completes a circuit through the other magnetic element in one of the stable reed positions or in passing.

In their simplest form reed switches in the prior art have characteristically employed a pair of electrically conductive, magnetic reed elements supported by a glass capsule, or other rigid non-magnetic supporting means, in positions relative to one another such that when no magnetic field is applied the magnetic elements assume positions separated from one another by a small gap. When a magnetic field is applied, magnetic flux lines concentrate into the low magnetic reluctance magnetic elements and the magnetomotive force will cause the magnetic elements to pull together in overlapping and electrically contacing relationship to simultaneously reduce magnetic reluctance and complete an electrical circuit through the contacting area of the electrically conductive magnetic elements. When the magnetic field is removed, the inherent resilience of at least one of the magnetic elements causes them to return to their normally separated condition.

Particularly in dry switches, there has been a tendency for contact bounce to occur, when the magnetic reed elements are drawn into contact with one another. That is, the inertia of the opposed magnetic elements causes them to bounce away from one another under the impact of contact, and there may be an undesirable period of making and breaking of the contacts until the energy involved producing the bouncing is absorbed and the oscillation is damped. In many applications this contact bounce is considered intolerable. It was for this reason, perhaps among others, that mercury wetted reed relay contacts were invented in the first place.

Whatever the reason, in some instances in the prior art mercury has been applied to the contact surfaces in order to obtain positive uniform contact between the magnetic elements. The mercury prevents intermittent circuit breaks after closure due to "contact bounce". However, in such switches the mercury may tend to amalgamate, or otherwise take on metals of supports and other switch parts, and some of the alloys or components formed may crystallize into solid form. Under these circumstances if contacts are together for long periods of time, or at elevated temperatures, they may tend to stick together instead of opening under the magnetic forces or the restoring force of the inherent resiliency of at least one of the magnetic elements when the magnetic field is removed. Characteristically, the mercury between the contacts does not prevent a direct metal-to-metal contact between the magnetic elements or at least a very close proximity of the contacts. Under conditions where the spacing between solid metal magnetic element of the contacts is less than the dimension of crystals of mercury amalgams, and the like, switch contacts have tended to stick closed at high temperatures or under conditions of long closure.

The present invention employs magnetic reed elements which do not overlap and therefore never come directly into contact with one another. Instead the magnetic elements are arranged so that they are effectively essentially axially aligned when the magnetic flux is applied. Reed switch movement is accomplished, just as it has been in the past, by alternate application of a magnetic field and removal thereof. Application of the magnetic field forces the magnetic elements in opposition to their internal natural resilience, or other restoring force, to assume a stable reluctance minimizing position of axial alignment. Removal of the magnetic field causes the magnetic elements to resume the stable positions previously occupied before magnetic force is applied in response to their natural resilience.

In the present invention the ends of the magnetic elements must be sufficiently closed spaced and have an end configuration assuring an extension pool of mercury at the end of at least one element will reach across the gap to the other magnetic element.

More specifically, the present invention concerns a reed switch employing magnetic elements of conductive, magnetic material, at least one of which is movable such that in the presence of a magnetic field said magnetic elements will change contact condition, such that at least one element moves to a magnetic reluctance minimizing position, in which position said magnetic elements are axially aligned, or more nearly so, but not contacting. Rigid non-magnetic supporting means supports the magnetic elements in predetermined non-aligned position relative to each other. Conductive liquid on at least one of the magnetic elements conductively extends said element into a position to complete an electrical circuit from its supporting magnetic element to the other magnetic element in one of the stable positions or during movement. Movement is in response alternately to magnetic element aligning force and at least another force restoring at least one movable element to another stable position. Frequently, this restoring force is the internal resilience of the moving magnetic or its support.

Figure 2:
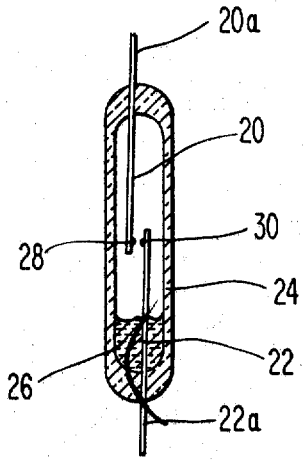
PRIOR ART Fig. 2
Figure 3A:
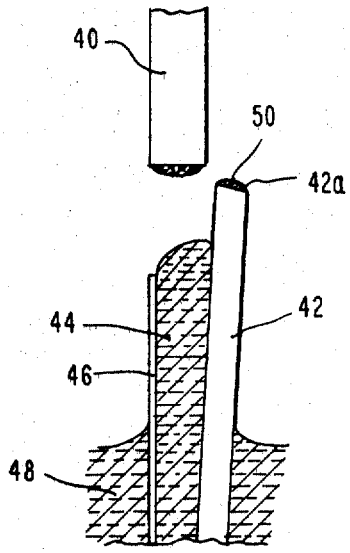
Figure 3B:
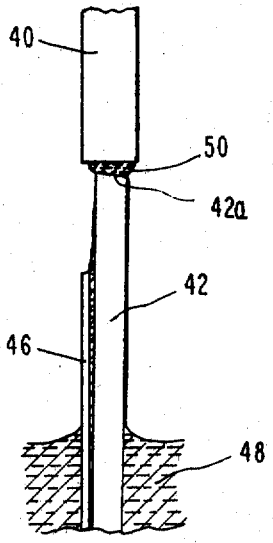

For a better understanding of the present invention, reference is made to the following drawings, in which:

FIG. 1 shows in axial section the simplest type of prior art reed switch and the winding constituting together a reed relay;

FIG. 2 is a similar sectional showing of a prior art mercury reed switch over which the present invention offers improvement; FIG. 3*a* is a similar view of still another type of mercury switch contacts in accordance with the present invention shown in open-contact, magnetic field removed condition; and FIG. 3*b* is a view of the switch contacts of FIG. 6*a* in magnetic field applied, closed-contact condition.

Referring to FIG. 1, the simplest type of reed switch is illustrated. In this structure a pair of flexible resilient, conductive, magnetic reed elements 10 and 12 are shown supported by a glass, or other insulating non-magnetic, in their normally open condition by envelope 14, which might be any other rigid non-magnetic supporting means. However, when current flows through coil 16 surrounding the envelope 14, the generally axial magnetic field seeks the highly permeable path of the magnetic elements 10 and 12 and flux lines crowd into that low magnetic reluctance path. The magnetic flux crosses the high reluctance air gap between the reeds and sets up a magnetomotive force tending to draw the flexible reeds together. The ends 10a and 12*a* of the magnetic reed elements outside of the envelope 14 are used as terminals to connect the magnetic elements, which are also conductive, in series in an electrical circuit. A normally open switch, as shown, will close upon application of a magnetic field and reopen under the resilient restoring forces of the magnetic reed elements upon removal of the magnetic field.

A variation of the reed switch illustrated in FIG. 1 is shown in FIG. 2. Referring to FIG. 2, the illustrated switch comprises a pair of magnetic reed elements 20 and 22 within and supported by a glass envelope 24. The envelope may also be made of other non-magnetic material which is also preferably insulating, or even conductive with insulating inserts to insulate the supported conductors from one another. In this embodiment, the vertical orientation is employed in operation to locate the mercury pool 26 which feeds the contacts with mercury through capillary grooves in magnetic element 22 or by other conventional means. Both magnetic elements in a mercury reed switch are commonly made of an alloy, such as 52 alloy (consisting of essentially 52% nickle and 48% iron). The opposed facing internal contact regions at the end of each magnetic element 20 and 22 are provided with contacts 28 and 30, respectively. The magnetic elements 20 and 22 also serve as electrical connectors or terminals in those portions 20*a* and 22*a* outside of the glass envelope 24. Again, a coil similar to that used with FIG. 1 may supply the magnetic field to actuate this switch. In this particular embodiment, both magnetic elements are flexible and rely on their own internal resilience to return from closed-contact position to the open position shown upon removal of the magnetic field.

In other embodiments of the prior art, only other than internal resilience of the magnetic elements may be used. In some embodiments, the movable element is a flexible reed or swinger. The mercury 26 may be pure mercury, or it may be saturated with selected dopant, or may have a piece of oxygen-free high conductivity copper wire within the mercury pool to cause the mercury to become copper saturated.

In practice, with mercury wetted contacts, amalgamation has been a problem, even though it may be minimized or reduced, and the prior art has been directed primarily to a minimizing of the amalgamation or crystal formation within the mercury. Part of the problem is that over a period of time, particularly with the contacts closed, crystal formation between the contacts may cause the contacts to stick. We have determined, however, that it is crystal growth of a size on the order of the spacing between the contacts which produces the problem. That is, the contacts themselves are normally in direct contact or in a very close proximity with the mercury simply filling any gap and improving the contact.

In our invention, because of the geometries intentionally employed for the first time, the contacts at their closest approach are preferably separated by a greater distance than the size of crystals, which distance is filled with mercury to complete the circuit. Therefore, formation of crystals, if it occurs, is not deleterious to the operation of the switch.

Observation of FIGS. 1 and 2 makes it clear that, as a matter of conventional practice, the magnetic elements in so-called reed switches have been overlapping, with the switches in most cases being closed by pulling the magnetic elements together under the effects of magnetic flux. In accordance with our invention, instead of overlapping the magnetic reed elements, these elements are terminated short of each other so as to completely pass one another and to be drawn into axial alignment in order to reduce magnetic reluctance.

FIGS. 3*a* and 3*b* illustrate somewhat schematically, and greatly enlarged, the contact area of the internal ends of the two magnetic elements of a reed switch in accordance with the present invention, respectively, in open and closed contact condition. The magnetic reed elements 40 and 42 do not overlap one another laterally as in the prior art. FIG.. 3*a* shows the magnetic elements out of alignment in a stable initial position assumed and resumed when no magnetic field is present. FIG. 3*b* shows the same elements drawn into alignment by the imposition of a magnetic field. Magnetic flux concentrates into the magnetic structure of the magnetic elements and draws them into axial alignment in order to minimize the reluctance of the magnetic path by reducing the air gap to a minimum. In this structure, as a variation over that of FIG. 2, for example, magnetic element 40 may be a fixed pole piece and magnetic element 42, a mercury wetted armature. In the embodiment illustrated in FIGS. 3*a* and 3*b*, pole 40 is of larger diameter than armature 42. In their magnetically actuated stable position, there is preferably a spacing between pole 40 and the armature 42 greater than the size of crystals which tend to form in mercury due to amalgamation. Armature 42 is mercury-wetted in the contact area from a mercury pool 48 similar to that in the structure of FIG. 2, for example.

As shown in FIGS. 3*a* and 3*b*, the end 40*a* of pole piece 40 has a chamfered face, not parallel to the opposed squared face of armature 42. Magnetic flux tends to crowd toward that edge which provides the smallest air gap and that edge may tend to align to one side of the axial center, as shown in FIG. 3*b*, into a stable off-center position of minimum reluctance. By designing the shape or contour of the opposed faces of the magnetic elements, the stable position of the elements under the magnetic field may be varied. The position finally assumed will be that position which minimizes the reluctance of the magnetic path subject to bias or other opposed forces. In accordance with the present invention, then, it is possible to shape or contour either or both the faces of the magnetic elements, here 40*a* and 42*a* relative to one another to achieve any desired realignment of the magnetic elements. Movement between the position of FIG. 3*a* and the position of FIG. 3*b* is due to magnetic forces. Return to the position of FIG. 3*a*, after the magnetic field is removed, is due to inherent resiliency of the armature 42 or to suitable spring means connecting the armature to a terminal member or to other restoring force effects known in the prior art, including different magnetic field effects. In practice, when armature 42 is pulled into alignment with pole piece 40 by a magnetic field, it will not tend to overshoot and bounce off the contact, as in the prior art, because it does not reach the metal of the contact. FIG. 4*a* shows the rest or stable position in which a magnetic field is not applied and in which the contacts are open. As shown, a reservoir of mercury 48 is provided between armature 42 and a fixed wall 46, positioned close enough to the armature in the position of FIG. 3*a* to cause a capillary attraction of the mercury from a pool 48 similar to that shown in FIG. 2 to a level near the end of armature 42. Conventional capillary grooves or the like, may be employed to aid in attracting mercury to the end of the armature to form mercury extension 50. As the magnetic force is applied, armature 42 is drawn into axial alignment with the pole piece 40. The design is such that upon the initial closure, the mercury extension will overlap and contact the end of the armature or quickly be built up to fill in the gap. The squeezing of the mercury between the wall 46 and armature 42 causes a pumping action to force mercury up the armature toward its end, such that mercury would be present in sufficient quantity to be drawn into and fill the narrow gap between the respective ends of pole 40 and armature 42. As shown in this application, armature 52 may be provided with a chamfered face 42*a* in order to cause it to align itself at the edge of pole 40 nearest the mercury reservoir whereby a greater pumping action may be achieved. When the magnetic field is removed, the internal resilience of armature 42, or other restoring force built into the system, will cause armature 42 to resume the position shown in FIG. 3*a*. As the ends of magnetic elements 40 and 42 separate, a shearing action is imposed on the mercury 50 which tends to make the contacts break more easily. However, the dimensions of the gap may be selected so that the gap is sufficiently wide to inhibit or prevent the growth of crystals of amalgam but close enough to aid in drawing mercury into the gap.

Should the reed switch of the present invention contain mercury wetted contacts, no dopant or other material need be employed for the purpose of preventing contact sticking due to crystalization. In fact, pure mercury can be used and no special precautions need to taken about the metals used for contacts. The extension means may be caused to pass the other magnetic element in a brushing movement so that at no point is it as close to the other reed through which the electrical path is completed as the largest possible crystal which would be formed by a mercury amalgam and might cause sticking but such that the mercury will bridge the gap. The contacts may also be designed so that they are of such a width in the direction of brushing movement that any oscillations which may occur as the reeds assume a stable position relative to one another after movement are smaller in amplitude than the width of the contact so that contact is maintained throughout, even though physical contact may occur over an area than at a designated point.

Many other modifications will occur to those skilled in the art. All such modifications within the scope of the claims are intended to be within the scope and spirit of the present invention.

We claim:

1. A reed switch employing elongated magnetic elements of conductive, magnetic material, rigid non-magnetic, non-conductive enclosure through which said magnetic elements extend and by which said magnetic elements are supported in predetermined non-aligned position relative to each other, at least one of which magnetic elements is movable, such that in the presence of a magnetic field said magnetic elements will move to a magnetic reluctance minimizing position in which position said magnetic elements are at least in part aligned but not contacting, the space between the unsupported ends of the magnetic elements when aligned being sufficiently small to cause capillary attraction of conductive liquid into said space, a conductive liquid within said envelope and a reservoir therefor, and an elongated member supported in side-by-side relationship with said at least one movable magnetic element in position to draw said conductive liquid from the reservoir into a space between said elongated member and said movable magnetic element and positioned to squeeze said conductive liquid toward the end of said magnetic element which the movable magnetic element is moved into alignment with the other magnetic element such that said conductive liquid will be drawn into the space between the ends of the magnetic elements by capillary attractions in said aligned position.

2. The reed switch of claim 1 in which the elongated member in side-by-side relationship with the magnetic member is stationary and permits only limited yielding of its position.

3. The reed switch of claim 1 in which the conductive liquid is liquid mercury or an amalgam thereof which in the aligned condition of the magnetic elements bridges the gap to close the circuit.

* * * * *

UNITED STATES PATENT OFFICE

CERTIFICATE OF CORRECTION

Patent No. 4,085,392 Dated April 18, 1978

Inventor(s) Laimons Lacis and Steven Horvath

It is certified that error appears in the above-identified patent and that said Letters Patent are hereby corrected as shown below:

Column 2, line 12, "closed" should be --close--;

Column 5, line 7, "52" should be --42--;

Column 5, line 27, "to" should be --be--;

Claim 1, line 29, "which" should be --when--.

Signed and Sealed this

Fifth Day of September 1978

[SEAL]

Attest:

RUTH C. MASON
*Attesting Officer*

DONALD W. BANNER
*Commissioner of Patents and Trademarks*